US008431497B2

(12) United States Patent
Davidson et al.

(10) Patent No.: US 8,431,497 B2
(45) Date of Patent: Apr. 30, 2013

(54) CLEAN ROOM WIPES

(75) Inventors: Adam S. Davidson, Winston-Salem, NC (US); Susan E. Faile, Asheboro, NC (US)

(73) Assignee: Berkshire Corporation, Whitsett, NC (US)

( * ) Notice: Subject to any disclaimer, the term of this patent is extended or adjusted under 35 U.S.C. 154(b) by 804 days.

(21) Appl. No.: 12/546,912

(22) Filed: Aug. 25, 2009

(65) Prior Publication Data

US 2011/0048977 A1 Mar. 3, 2011

(51) Int. Cl.
*B32B 27/12* (2006.01)
*D01F 9/22* (2006.01)

(52) U.S. Cl.
USPC ..... 442/121; 510/438; 510/441; 8/115.6

(58) Field of Classification Search ..... 510/438, 510/439, 441; 8/115.6, 115.54, 115.56; 442/121
See application file for complete search history.

(56) References Cited

U.S. PATENT DOCUMENTS

| | | | | |
|---|---|---|---|---|
| 3,951,926 | A | 4/1976 | Hu | 526/232 |
| 4,025,482 | A | 5/1977 | Hu | 260/29.6 |
| 4,624,890 | A | 11/1986 | Lloyd et al. | 428/290 |
| 4,673,523 | A | 6/1987 | Smith et al. | 252/91 |
| 4,784,786 | A | 11/1988 | Smith et al. | 252/91 |
| 5,094,770 | A | 3/1992 | Sheridan et al. | 252/91 |
| 5,229,181 | A | 7/1993 | Daiber et al. | 428/58 |
| 5,271,995 | A | 12/1993 | Paley et al. | 428/224 |
| 5,895,504 | A | 4/1999 | Sramek et al. | 8/137 |
| 5,996,797 | A * | 12/1999 | Flaig | 206/494 |
| 6,189,189 | B1 * | 2/2001 | Morin et al. | 28/166 |
| 6,513,184 | B1 | 2/2003 | Brown et al. | 15/231 |
| 6,740,608 | B1 | 5/2004 | Morin et al. | 442/181 |
| 7,048,806 | B2 | 5/2006 | Ochomogo et al. | 134/34 |
| 7,432,234 | B2 | 10/2008 | Ochomogo et al. | 510/499 |
| 2002/0050016 | A1 | 5/2002 | Willman et al. | 15/104.002 |
| 2002/0102382 | A1 | 8/2002 | Kwong et al. | |
| 2002/0183233 | A1 | 12/2002 | Mitra et al. | |
| 2005/0266752 | A1 | 12/2005 | Morin et al. | 442/59 |
| 2006/0025527 | A1 | 2/2006 | Chou | 525/191 |
| 2006/0051266 | A1 | 3/2006 | Green et al. | |
| 2006/0094320 | A1 | 5/2006 | Chen et al. | |
| 2007/0155645 | A1 | 7/2007 | Eisfeld et al. | 510/439 |
| 2007/0299383 | A1 | 12/2007 | Murphy et al. | |
| 2008/0057808 | A1 | 3/2008 | Simandl et al. | 442/59 |
| 2009/0000040 | A1 | 1/2009 | Ikemizu | |

FOREIGN PATENT DOCUMENTS

| | | |
|---|---|---|
| DE | 19952787 | 5/2000 |
| EP | 0936226 | 8/1999 |
| JP | 08208899 | 8/1996 |
| JP | 11315114 | 11/1999 |
| WO | WO/01/80706 | 11/2001 |
| WO | WO/2006/015201 | 2/2006 |

* cited by examiner

*Primary Examiner* — Jenna Johnson
(74) *Attorney, Agent, or Firm* — MacCord Mason PLLC

(57) ABSTRACT

A supply of clean room wipes. The supply of clean room wipes includes a sealed package and a plurality of wipes within the sealed package. The wipes in the package include a substrate and an anhydride finish applied to the substrate. The treated wipes have a Strength Contribution from Treatment (lbs) when tested using a standard trap tear method ASTM D 5587:1996 of greater than about 10% and an average improvement in Percent Carbon Black Pick-Up greater than about 10% compared to an untreated wipe. In addition, a sealed edge may be applied along the perimeter of each wipe to prevent loss of material from the wipe during use.

51 Claims, 11 Drawing Sheets

| | | | | | | | | Particle Capture (Cumulative %) | | | Particle Retention (Cumulative %) | | | | | |
|---|---|---|---|---|---|---|---|---|---|---|---|---|---|---|---|---|
| Sample | Product Name | Manufacturer | Knit Construction | Basis Weight (g/m2) | Chemical Treatment (% on wt. of fabric) | Biaxial Shake Particle Generation (>0.5μm x10$^3$/cm$^2$) | Helmke Drum Particle Generation (>0.5μm / ft$^3$ / wiper) | Carbon Black Pick-Up | ≥1μm | ≥2μm | ≥5μm | ≥1μm | ≥2μm | ≥5μm | Average Strength (pounds) | Treatment Strength Contribution (pounds) |
| 1 | ValuSeal® LP | Berkshire | Modified Pique | 155 | 0.16% EMA | 0.85 | N/T | 61.0% | 8.1% | 27.7% | 69.6% | 7.0% | 78.8% | 91.3% | 23.5 | 2.27 |
| 2 | ValuSeal® LP | Berkshire | Modified Pique | 143.5 | 0.20% EMA | 0.58 | 4 | 69.0% | 14.8% | 51.3% | 83.3% | 36.5% | 86.3% | 94.3% | 22.9 | 3.37 |
| 3 | ValuSeal® LP | Berkshire | Modified Pique | 142 | NONE | 0.31 | N/T | 41.8% | 0.0% | 0.0% | 0.0% | N/C | N/C | N/C | 20.5 | 0 |
| 4 | MicroSeal® VP | Berkshire | Interlock | 132 | 0.20% EMA | 0.8 | 2.5 | 73.4% | 10.4% | 55.8% | 80.0% | 16.9% | 85.6% | 92.5% | 38.7 | 6.81 |
| 5 | MicroSeal® VP | Berkshire | Interlock | 129 | NONE | 0.51 | 3 | 52.2% | 0.0% | 0.0% | 1.3% | N/C | N/C | 0.0% | 31.8 | 0 |
| 6 | Anticon Heavy Wt. w/PAT | Milliken & Co. | Mock Pique | 150 | UNKNOWN | 0.23 | 13 | 63.5% | 29.1% | 55.7% | 82.3% | 51.5% | 85.1% | 94.7% | 17.7 | N/T |
| 7 | Anticon Heavy Wt. | Milliken & Co. | Mock Pique | N/T | NONE | N/T | N/T | 37.5 | N/T | N/T | N/T | N/T | N/T | N/T | 18.8 | N/T |
| 8 | Anticon White Magic w/PAT | Milliken & Co. | Interlock | 125 | UNKNOWN | 0.42 | 12 | 72.7% | 4.3% | 31.7% | 79.5% | 67.9% | 91.5% | 88.7% | N/T | N/T |
| 9 | Anticon White Magic | Milliken & Co. | Interlock | 114 | NONE | 0.68 | N/T | 47.1% | 0.0% | 0.0% | 0.0% | N/C | N/C | N/C | N/T | N/T |
| 10 | Anticon Lite w/PAT | Milliken & Co. | Mock Pique | 111 | UNKNOWN | 0.53 | 17 | 56.6% | N/T | N/T | N/T | N/T | N/T | N/T | N/T | N/T |
| 11 | Anticon Standard Wt. w/PAT | Milliken & Co | Mock Pique | 126 | UNKNOWN | 0.35 | 16 | 63.3% | N/T | N/T | N/T | N/T | N/T | N/T | N/T | N/T |
| 12 | Vectra Alpha Nu | ITW Texwipe | Interlock | 123 | UNKNOWN | 0.78 | N/T | 22.4% | 0.0% | 0.7% | 16.4% | N/C | 0.0% | 5.8% | N/T | N/T |

FIG. 11

CLEAN ROOM WIPES

BACKGROUND OF THE INVENTIONS (1) Field

The present inventions relate generally to a supply of clean room wipes and, more particularly, to a clean room wipes treated to provide improved strength and particulate capture over an untreated wipe.

(2) Related Art

Wipes find utility in cleaning surfaces, whenever it is desirable to minimize particulate contamination. Wipes are utilized for a number of different cleaning applications, such as in clean rooms, automotive painting rooms and other controlled environments.

Different applications require different standards that these types of wipes should attain. For example, wipes utilized in clean rooms must meet stringent performance standards. These standards are related to fluid sorbency and contamination, including maximum allowable particulate, unspecified extractable matter and individual ionic contaminants. The standards for particulate contaminant release are especially rigorous and various methods have been devised to meet them.

Wipes may be made from knitted, woven or non-woven textile fabrics. The fabric is cut into wipes, typically 9-inch-by-9-inch squares. The wipes may be washed in a clean room laundry, employing special surfactants and highly filtered and purified water, to reduce the contamination present on the fabric. After washing, the wipes may be packaged dry or pre-saturated with a suitable solvent.

The physical properties of wipes are generally dependent on the substrate the wipes are made from and the fabric are often sealed along the edges or otherwise further enhanced mechanically.

Thus, there remains a need for a new and improved clean room wipe that is suitable for such use while, at the same time, is treated to provide improved strength and particulate capture over an untreated wipe.

SUMMARY OF THE INVENTIONS

The present inventions are directed to a supply of clean room wipes. The supply of clean room wipes includes a sealed package and a plurality of wipes within the sealed package. The wipes in the package include a substrate and an anhydride finish applied to the substrate. The treated wipes have a Strength Contribution from Treatment (lbs) when tested using a standard trap tear method ASTM D 5587:1996 of greater than about 10% and an average improvement in Percent Carbon Black Pick-Up greater than about 10% compared to an untreated wipe. In addition, a sealed edge may be applied along the perimeter of each wipe to prevent loss of material from the wipe during use.

Preferably, the substrate is formed of synthetic yarns. The synthetic yarns may be polyester of between about 30 denier and about 200 denier. Preferably, the synthetic yarns are about 70 denier. In addition, the synthetic yarns may be texturized such as air texturized and air texturized without entanglement. Preferably, the substrate is between about 40 gms/meter$^2$ and about 300 gms/meter$^2$. The substrate may be formed by circular knitting and slit prior to packaging.

Preferably, the anhydride finish is topically applied and is applied by immersion and padding. Preferably, the anhydride finish is between about 0.02 wt. % and 2 wt. % solids on weight of fabric with between about 0.1 wt. % and 0.5 wt. % solids on weight of fabric being most preferred. Preferably, the anhydride finish is a co-polymer and preferably is ethylene maleic anhydride (EMA).

The wipes may further including a saturant. The saturant may be chosen from alcohols, water, ketones, hypochlorites, peroxides, biostats, biocides, lubricants, surfactants and mixtures thereof. In some cases, the wipes are clean room may be laundered prior to packaging. The wipes may also be sterilized and may be irradiated until substantially sterile after packaging.

The wipes may further including an outer bag surrounding said sealed package, which is adapted to be removed prior to use. The sealed package may be resealable. The sealed package may be solvent resistant. In addition, the sealed package may forms a sterile barrier between the environment and said plurality of wipes. The material forming the sealed package may be selected from the group consisting of laminates, films, metalized films and combinations thereof.

Accordingly, one aspect of the present inventions is to provide a supply of clean room wipes, the product includes: (a) a sealed package; and (b) a plurality of wipes within the sealed package, the plurality of wipes having a Strength Contribution from Treatment (lbs) when tested using a standard trap tear method ASTM D 5587:1996 of greater than about 10% and an average improvement in Percent Carbon Black Pick-Up greater than about 10% compared to an untreated wipe.

Another aspect of the present inventions is to provide a textile article having a particle capturing finish, the product including: (a) a substrate; and (b) an anhydride finish applied to the substrate.

Still another aspect of the present inventions is to provide a supply of clean room wipes, the supply of clean room wipes including: (a) a sealed package; (b) a plurality of wipes within the sealed package, the wipes including (i) a substrate and (ii) an anhydride finish applied to the substrate, wherein the plurality of wipes having a Strength Contribution from Treatment (lbs) when tested using a standard trap tear method ASTM D 5587:1996 of greater than about 10% and an average improvement in Percent Carbon Black Pick-Up greater than about 10% compared to an untreated wipe; and (c) a sealed edge along the perimeter of each wipe to prevent loss of material from the wipe during use.

These and other aspects of the present inventions will become apparent to those skilled in the art after a reading of the following description of the preferred embodiment when considered with the drawings.

BRIEF DESCRIPTION OF THE DRAWINGS

FIG. 11 is a compilation of experimental results.

DESCRIPTION OF THE PREFERRED EMBODIMENTS

Figure 1:
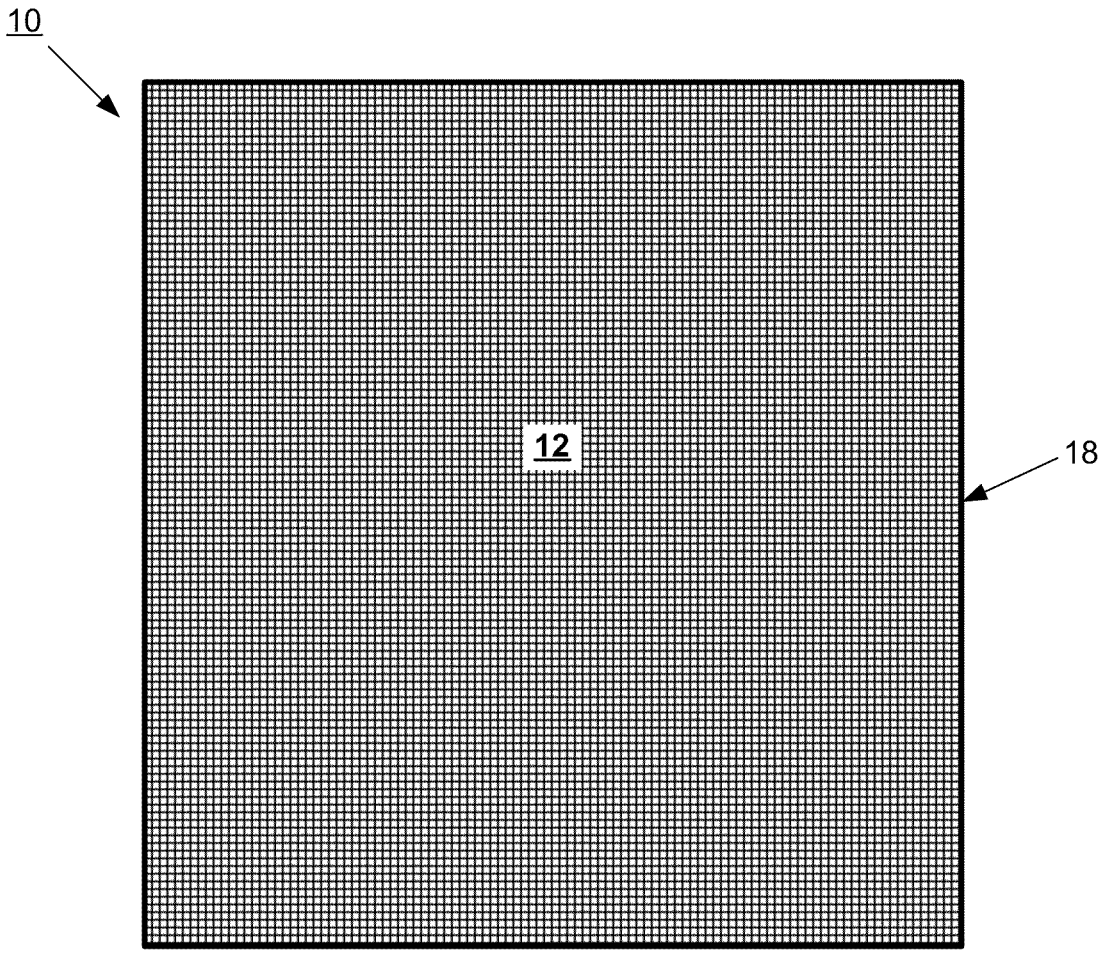
FIG. 1 is a top view of a wipe constructed according to the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the inventions and are not intended to limit the inventions thereto. As best seen in FIG. 1, a wipe formed from a textile article, generally designated 10, is shown constructed according to the present inventions. The textile article 10 includes a fabric substrate 12 and a sealed edge 18. As used herein, a "textile article" specifically includes wipes and cleaning cloths that are intended for either single or multiple uses, such as clean room wipes.

Fabric substrate 12 may be formed of synthetic yarns, with polyester being preferred. The preferred denier of the synthetic yarns is between about 30 denier and about 200 denier, with about 70 denier being most preferred. The synthetic yarns may be texturized, with air-texturized yarns being preferable, and air texturized synthetic yarns without entanglement being most preferred. Preferably, substrate 12 is between about 40 grams per meter squared (gm/meter$^2$) and about 300 gm/meter$^2$. Substrate 12 may be formed by circular knitting, and is preferably slit prior to packaging.

It is preferable that the perimeter of each textile article includes sealed edge 18 to prevent the loss of material during use. Specifically, frayed or shedding ends could undesirably contaminate an area with particles of yarn from substrate 12. Edge 18 can be sealed by hot knife, hot wire, hot, air jet, ultrasonic or laser, with ultrasonic or laser being the most preferred.

Textile article 10 includes a finish. Preferably, this finish is substantially insoluble in isopropyl alcohol at a temperature of greater than about 180 F (its boiling point) for about 5 minutes according to IEST-RP-CC-004.3 section 7.1.1. Preferably this finish is an anhydride, more preferably a co-polymer, with ethylene maleic anhydride (EMA) being most preferred. This finish is preferably applied to substrate 12 in a range of between about 0.02 percent by weight (wt. %) to about 2 wt. % of solids on weight of fabric substrate, with between about 0.1 wt. % to about 0.5 wt. % being more preferred, and about 0.2% being most preferred. Preferably this anhydride finish is topically applied, most preferably by immersion and padding.

Textile article 10 also preferably includes a saturant such as alcohol, water, ketone, hypochlorite, peroxide, biostat, biocide, lubricant, surfactant or mixtures thereof.

Figure 2:
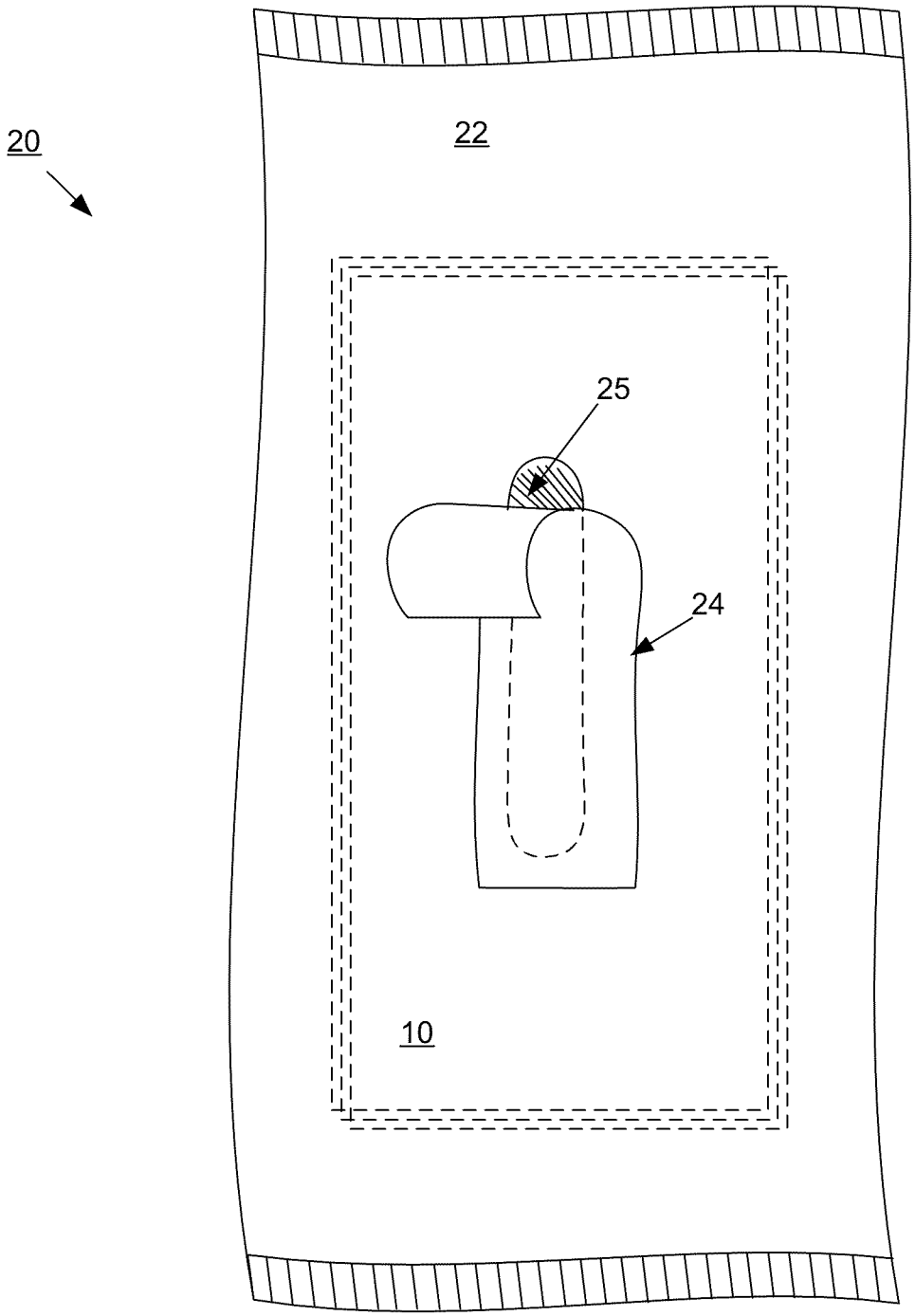
FIG. 2 is a top view of a supply of wipes including a package.

Referring now to FIG. 2, a plurality of textile articles 10 may be packaged within sealed package 22, thereby creating supply 20. Having a sealed package 22 is particularly important when supply 20 includes a saturant. The textile articles 10 of supply 20 are preferably clean room laundered and sterilized, most preferably irradiated, prior to packaging. Packaging 22 forms a sterile barrier between the environment and textile articles 10, and can be a variety of different types of containers known in the art such as pouches, bags, canisters, boxes or sleeves, with the preferred container varying according to the quantity of articles 10.

Where package 22 is intended to serve as a dispenser, it is desirable to cover dispensing opening 25 with a resealable closing mechanism such as flap 24, which can include adhesives, snaps, compression zippers, slider zippers and the like. Package 22 is preferably solvent resistant, and may include materials such as laminates, films, metalized films and combinations including at least one.

Figure 3:
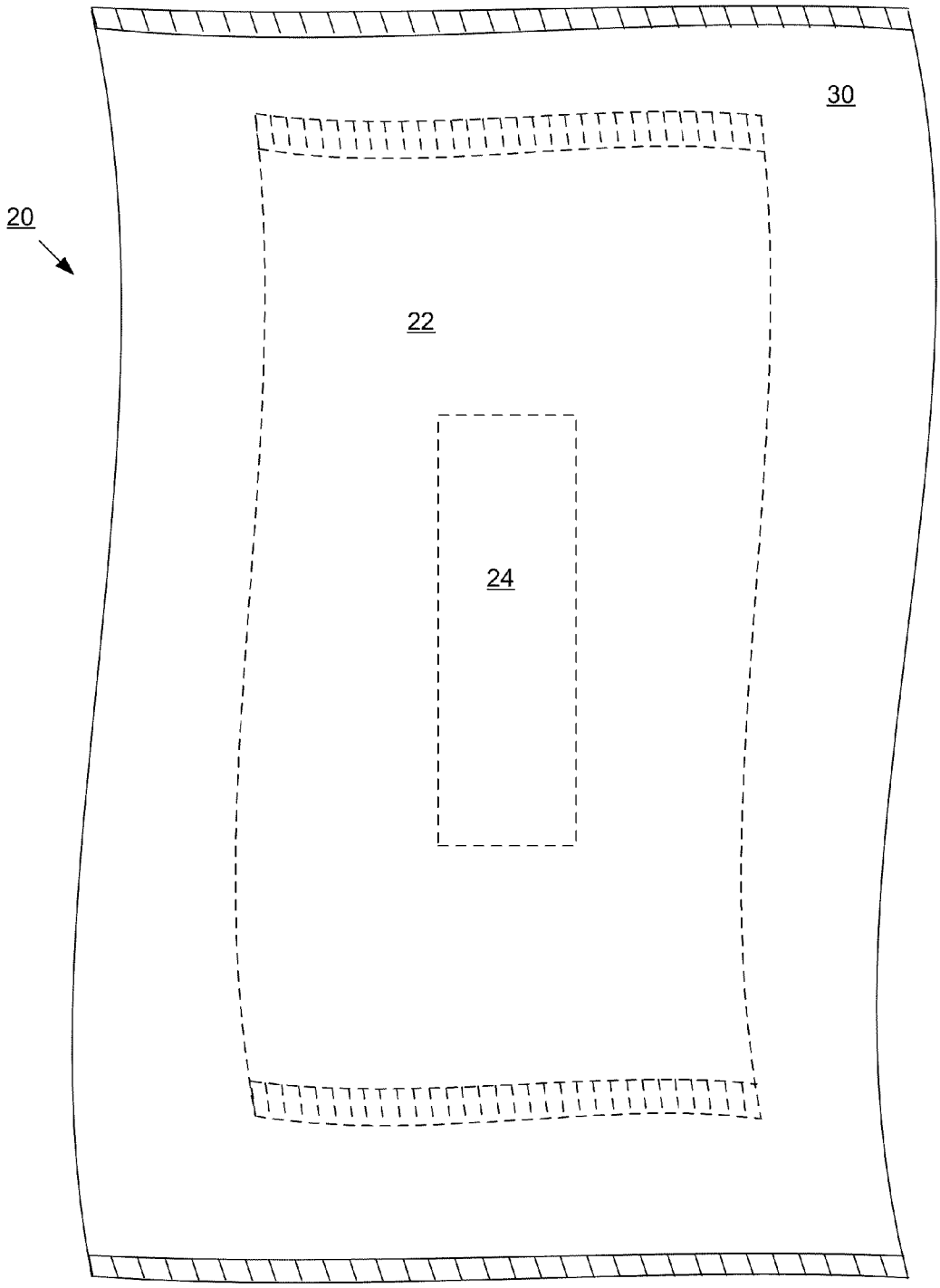
FIG. 3 is a top view of a supply of wipes inside an outer bag.

Referring now to FIG. 3, supply 20 may further include outer bag 30, which is adapted to be removed prior to use. This outer bag 30 would be employed to prevent contamination of environment by package 22.

In practice, a user could open outer bag 30 (if present), remove supply 20 and position supply 20 in a convenient location, such as in a clean room workstation. To prepare a surface, the user could pull back flap 24 to expose opening 25, reach through opening 25 to grasp a textile article 10, and pull textile article 10 through opening 25. Opening 25 could then be resealed with flap 24, and textile article 10 could be used to wipe a surface.

The present inventions are not only structurally novel, but they provide substantial and unexpected improvements over commercial clean room wipes. Specifically, the present inventions are stronger and have increased particulate capture then untreated wipes. Moreover, the particle capture and particle retention profiles and particle generation profiles are comparable to competitive wipes.

It should be noted that not all experiments were run on all samples. Accordingly, non-sequential sample numbers (i.e., "Sample 2", "Sample 3", "Sample 5", etc.) are reported in some Tables. This should not be construed as meaning that data has been selectively omitted. Rather, it would have been inconclusive and/or burdensome to run all experiments on all samples. Where a sample was tested, the data is either individually reported or reported as an average of other identical samples.

However, the characteristics of a given sample (i.e., product name, manufacturer, chemical treatment) are consistently referred to by the same sample number among the various experiments, although the actual physical sample is, obviously, not the same. As used herein, "N/T" means "Not Tested"; "N/C" means "Not Calculable" (e.g. because zero cannot be divided); "UNKNOWN" chemical treatment indicates that the wipe is marketed as having a treatment, but the identity of the treatment is unknown to Applicants; "VSLP" is the ValuSeal LP product; and "MSVP" is the MicroSeal VP product available from the Berkshire Corporation of Great Barrington, Mass. Finally, some graphs contain prophetic examples based on best estimates of what would be expected. A compilation of experimental results is reported in FIG. 11.

To test the strength of the present inventions compared to what is commercially available, clean room wipes were tested using a standard trap tear method, ASTM D 5587:1996. This is a trapezoidal tear method, in which a constant-rate-of-extension instrument (Instron) is used to determine tear strength of the knit as based upon the average of the five highest peaks obtained during testing.

For this test, a total of four repetitions were used per sample and data was collected from the course direction of the fabric. Wale direction data was not collected because previously performed wale strength experiments yielded non-reproducible data due to the fabric necking and snapping after extreme elongation. Comparisons were made between untreated wipes, wipes with EMA and wipes with a Particle Attraction Treatment (PAT) of unknown chemical identities.

Samples of untreated polyester knit wipes (VSLP and MSVP) were jet scoured, heat set, ultrasonically cut into 9"×9" wipes and laundered in an ISO Class 4 clean room laundry. A nonionic surfactant was added during laundering to aid in cleaning and increase absorbency of the finished wipes. Treated wipes were created in the same manner except that 0.16% or 0.20% on weight of fabric EMA was applied by padding to some samples before the heat set process. EMA is available from Vertellus Health & Specialty Products LLC of Indianapolis, Ind. under the trade name ZeMac® E400. These samples were tested against commercially available wipes with and without PAT.

TABLE 1

Comparison of Strength

| Sample | Product Name | Knit Construction/ weight | Chemical Treatment (% on wt. of fabric) | Average Strength (lbs) | Strength Contribution from Treatment (lbs) (adj for fabric wt) |
|---|---|---|---|---|---|
| 1 | ValuSeal LP | Modified Pique/144 gsm | 0.16% EMA | 23.5 | 2.27 |
| 2 | ValuSeal LP | Modified Pique/133 gsm | 0.20% EMA | 22.9 | 3.37 |
| 3 | ValuSeal LP | Modified Pique/139 gsm | NONE | 20.5 | 0 |
| 4 | MicroSeal VP | Interlock/127 gsm | 0.20% EMA | 38.7 | 6.81 |
| 5 | MicroSeal VP | Interlock/126 gsm | NONE | 31.8 | 0 |
| 6 | Anticon Heavy Wt. with PAT | Mock Pique/145 gsm | UNKNOWN | 17.7 | N/T |
| 7 | Anticon Heavy Wt. | Mock Pique/138 gsm | NONE | 18.8 | N/T |

Figure 4:
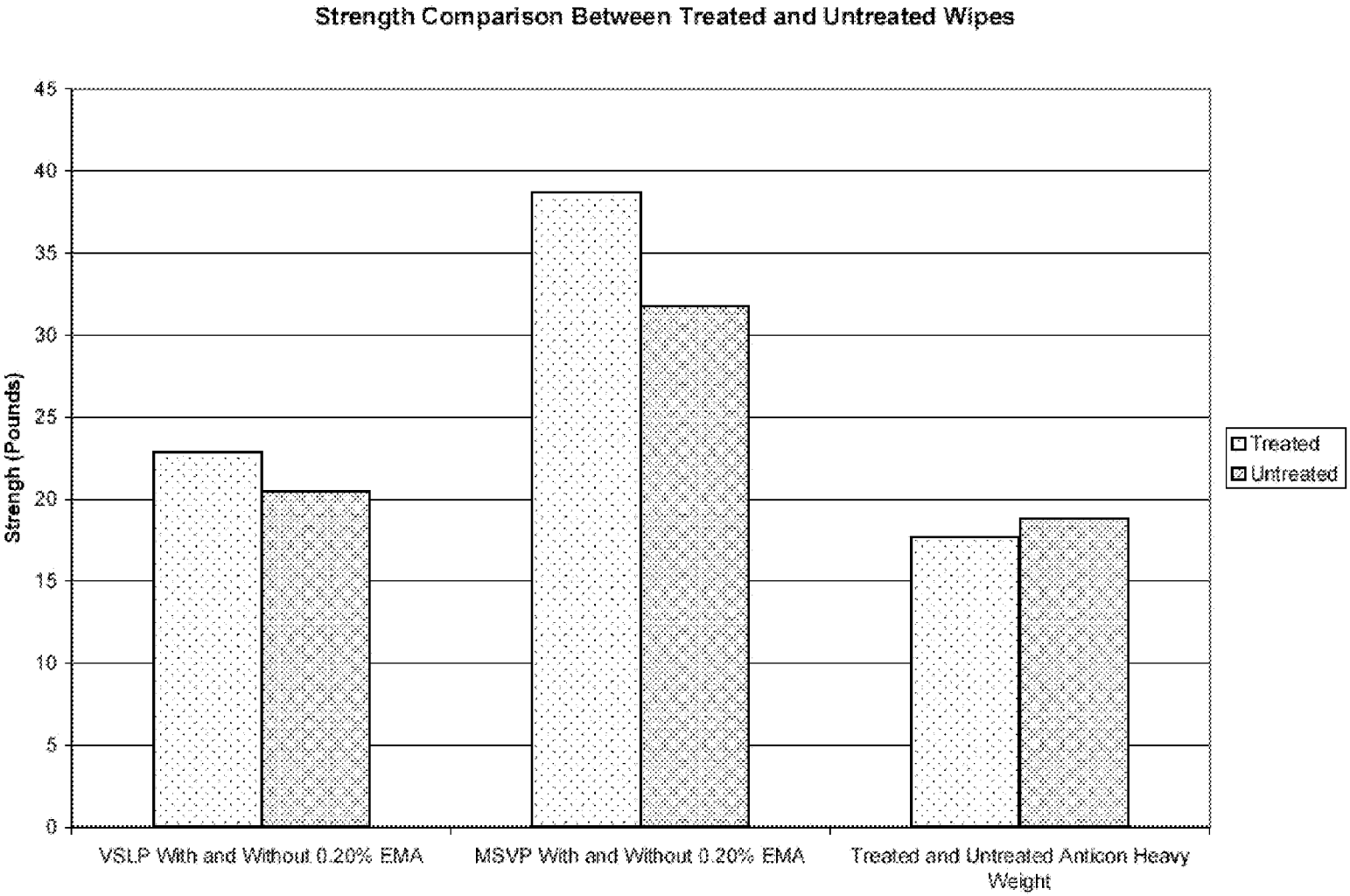
FIG. 4 graphically compares the strength of some embodiments of the present inventions with some commercially available products, using a bar graph.

As seen in the Table 1 and FIG. 4, wipes treated with about 0.2% EMA are significantly stronger than identical untreated wipes. Specifically, VSLP with 0.2% EMA is 11.5% stronger than VSLP without EMA; and MSVP with 0.2% EMA is 21.9% stronger than untreated MSVP. This strengthening characteristic remains true as the "Strength Contribution from Treatment" results show.

Figure 5:
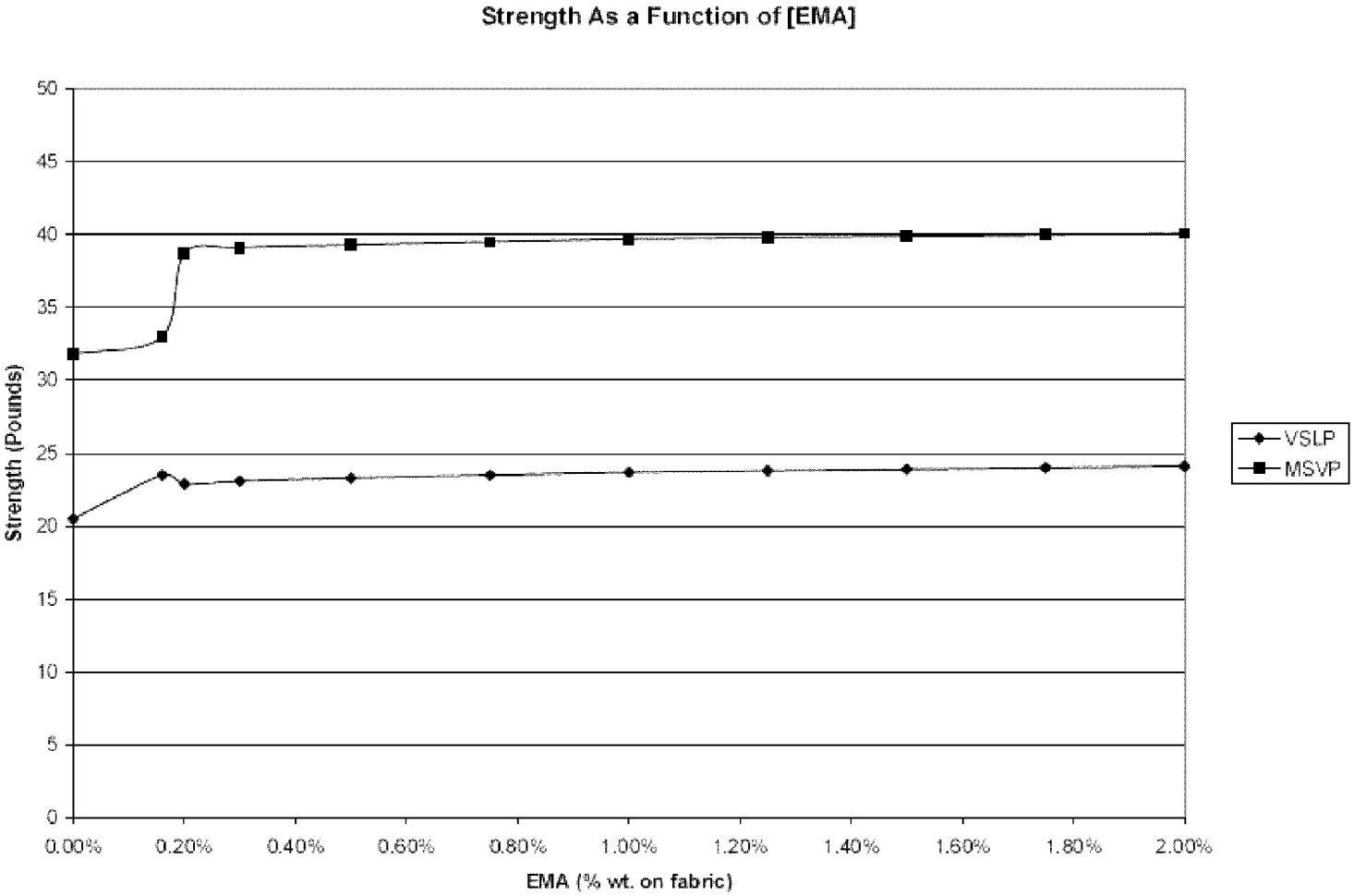
FIG. 5 graphically represents the effect of EMA on the strength of fabric substrates, using an XY scatter graph.

The dramatic strength imparted to MSVP by what are very low levels of EMA may be attributable to some effect of EMA on the fabric knit structure. This strength improvement capability of EMA is particularly significant and unexpected when compared to the effect of PAT on a commercially available wipe. Specifically, untreated Anticon Heavy Weight is no stronger than its PAT-treated counterpart is. Therefore, contrary to PAT, EMA strengthens while PAT shows no improvement in strength. It is hypothesized that EMA provides enhanced surface lubricity, which increases yarn slippage, thereby leading to the bunching of the yarns, which increases the tearing strength. The relationship between EMA and strength is represented in FIG. 5.

Another benefit of the present inventions is that it yields a superior wipe with respect to carbon black pick-up. Again, samples of untreated polyester knit wipes (VSLP and MSVP) were jet scoured, heat set, ultrasonically cut into 9"×9" wipes and laundered in an ISO Class 4 clean room laundry. A nonionic surfactant was added during laundering to aid in cleaning and increase absorbency of the finished wipes. Treated wipes were created in the same manner except that 0.16% or 0.20% on weight of fabric EMA was applied by padding to some samples before the heat set process. These samples were tested against commercially available wipes with and without PAT.

In the test, 40 mg±1.0 mg carbon black particles (Carbon Black M-1300, Cabot Corporation, USA) were weighed and placed in a beaker with 400 ml of water. A 9"×9" sample wipe was added to the beaker and stirred with a magnetic stirring bar for 30 seconds and removed. Excess water was squeezed from the wipe by hand and returned to the beaker. The water in the beaker was filtered through a 1.0 micron pore size glass fiber filter, which had been pre-weighed. The filter was dried and weighed, and the amount of carbon black left in the beaker after exposure to the wipe was calculated.

The Percent Carbon Black Pick-Up by the wipe was calculated using the following formula:

Initial Carbon Black in Beaker(mg)−Carbon Black on Filter(mg)/Initial Carbon Black in Beaker(mg)×100%

Table 2 below expresses the findings:

TABLE 2

Comparison of Carbon Black Pick-Up

| Sample | Product Name | Chemical Treatment (% on wt. of fabric) | Carbon Black Pick-Up |
|---|---|---|---|
| 1 | ValuSeal LP | 0.16% EMA | 61.0% |
| 2 | ValuSeal LP | 0.20% EMA | 69.0% |
| 3 | ValuSeal LP | NONE | 41.8% |
| 4 | MicroSeal VP | 0.20% EMA | 73.4% |
| 5 | MicroSeal VP | NONE | 52.2% |

TABLE 2-continued

Comparison of Carbon Black Pick-Up

| Sample | Product Name | Chemical Treatment (% on wt. of fabric) | Carbon Black Pick-Up |
|---|---|---|---|
| 6 | Anticon Heavy Wt. | UNKNOWN | 63.5% |
| 7 | Anticon Heavy Wt. | NONE | 37.5% |
| 8 | Anticon White Magic | UNKNOWN | 72.7% |
| 9 | Anticon White Magic | NONE | 47.1% |
| 10 | Anticon Light Wt. | UNKNOWN | 56.6% |
| 11 | Anticon Standard Wt. | UNKNOWN | 63.3% |
| 12 | Vectra Alpha Nu | UNKNOWN | 22.4% |

Figure 6:
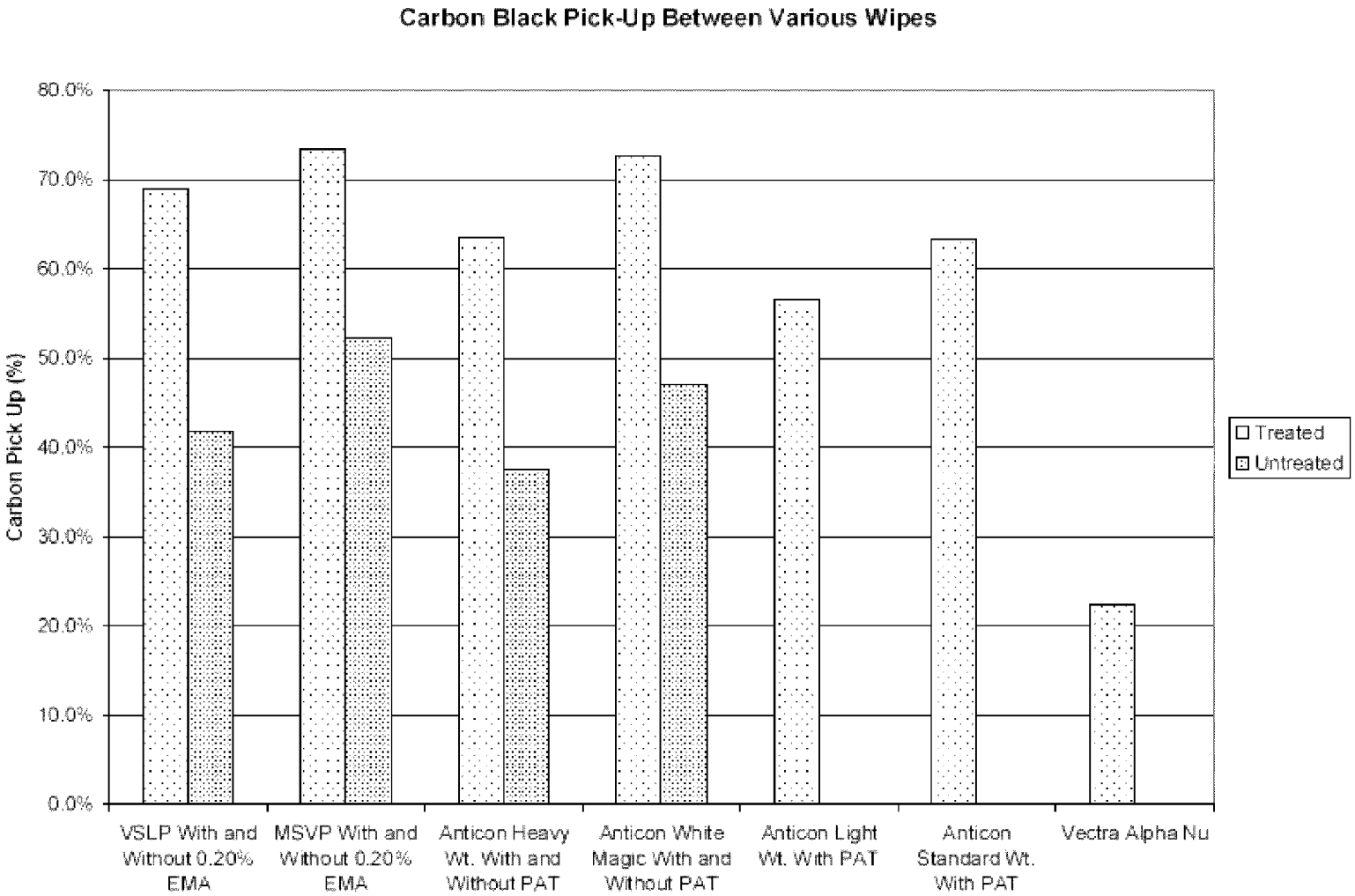
FIG. 6 graphically compares carbon pick-up percentages of some embodiments of the present inventions with some commercially available products, using a bar graph.
Figure 7:
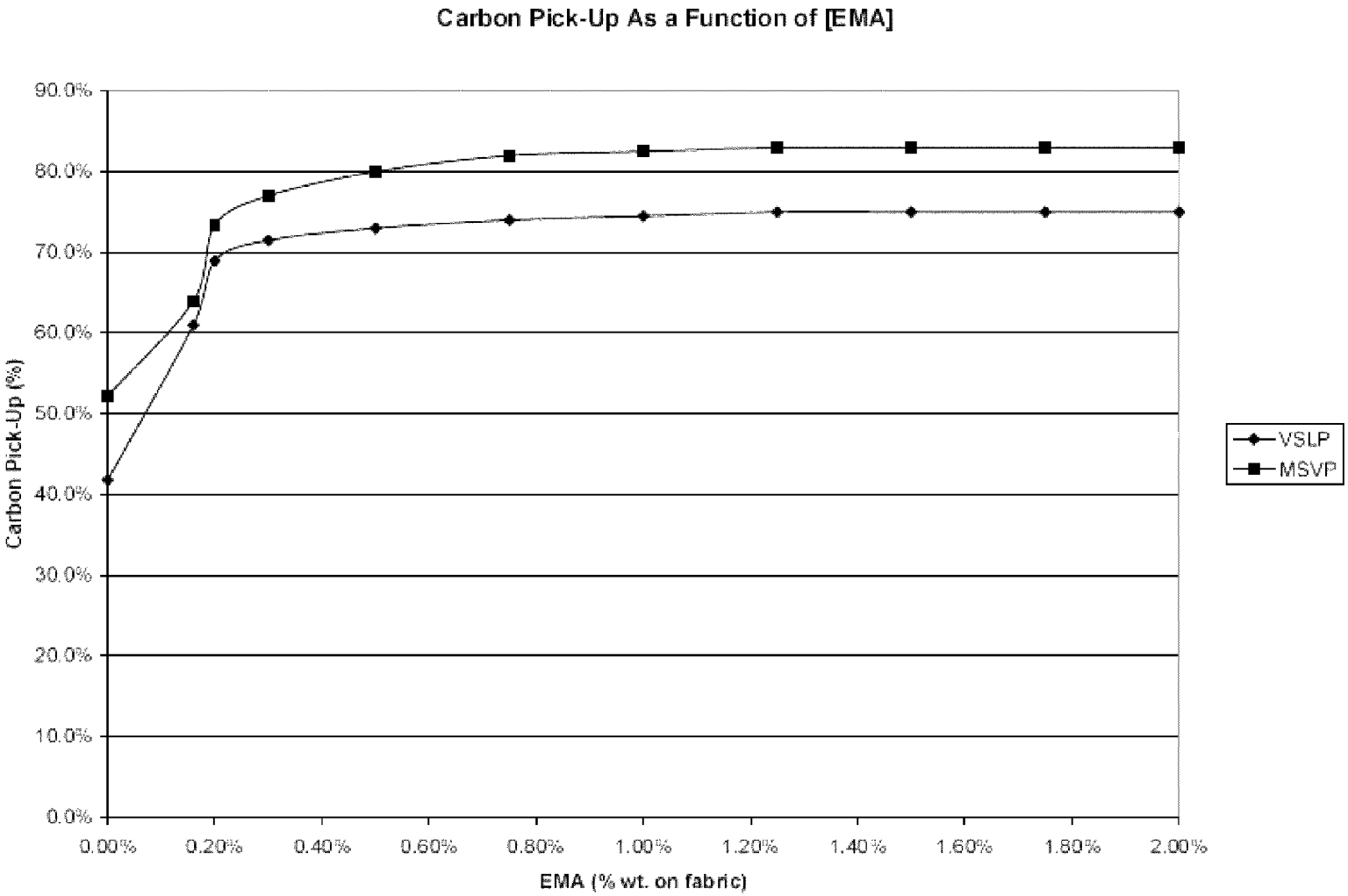
FIG. 7 graphically represents the effect of EMA on carbon pick up, using an XY scatter graph.
Figure 8:
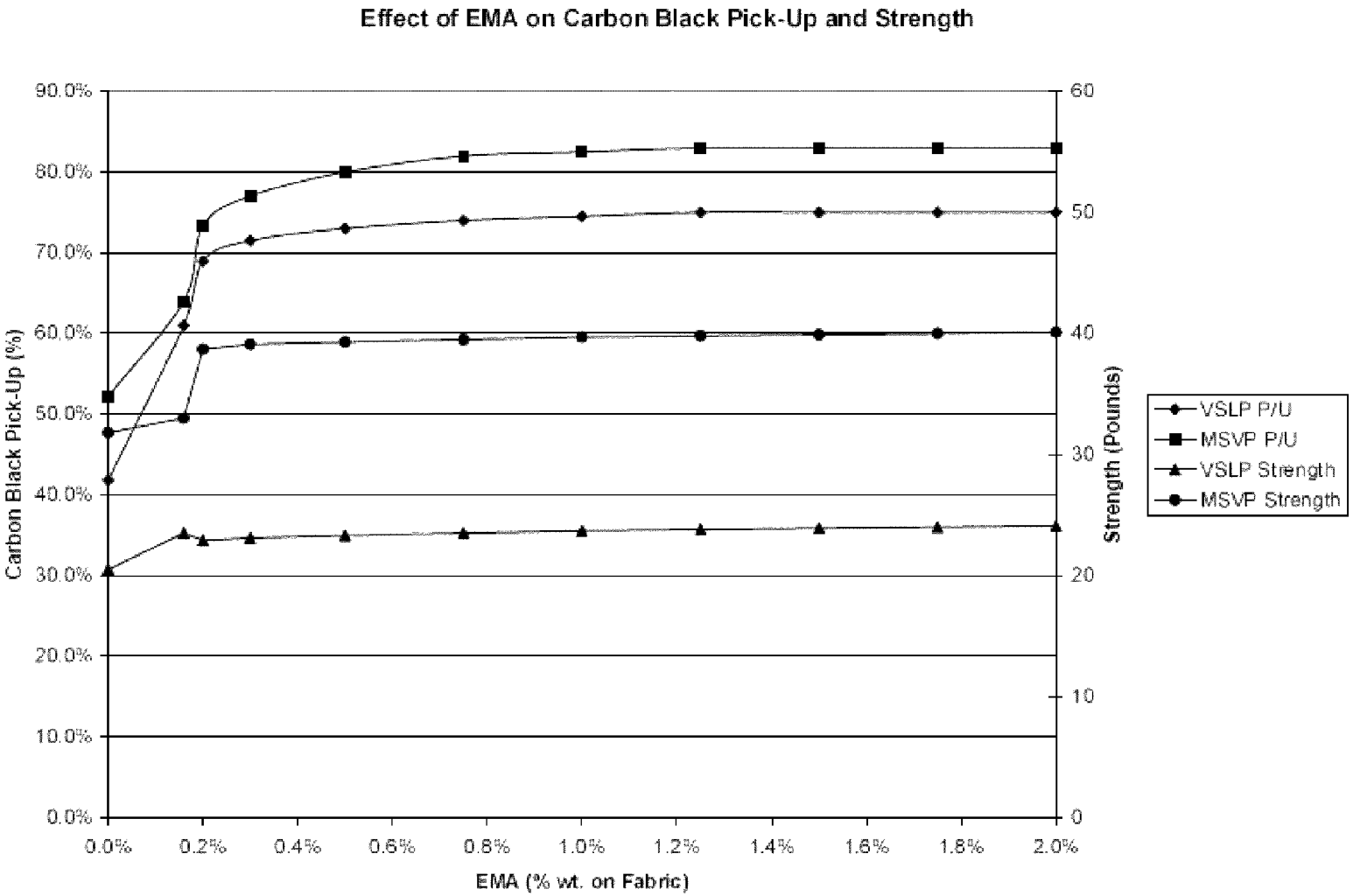
FIG. 8 graphically represents the effect of EMA on the strength of fabric substrates and carbon pick up, using an XY scatter graph with two Y-axes.

As shown in Table 2 and FIG. 6, MSVP with about 0.2% EMA has superior carbon black pick-up compared to all other samples tested. As represented in FIG. 7, the carbon pick-up appears to be a function of the concentration of EMA. Combining the data from Tables 1 and 2 into FIG. 8, it appears that both carbon pick-up and strength are a function of EMA concentration.

In addition to improvements in carbon black pick-up and strength, particle capture and particle retention profiles are also quite good for the EMA treated textile articles. In these experiments, VSLP and MSVP samples with and without EMA were prepared similarly to those prepared for the carbon black pick-up testing. The testing process used was based on IEST-RP-CC-004.3 Section 6.1.3, with particle counts measured and recorded as the cumulative number of particles by size (≧0.5 μm, ≧1 μm, ≧2 μm, ≧5 μm, ≧15 νm, and ≧25 μm) using a Hiac Royco 8000A Laser Particle Counter.

Specifically, a suspension containing 0.100 g carbon black (M-1300, Cabot Corporation, USA) in 3000 ml of filtered, deionized water was vigorously shaken and allowed to settle for 30 minutes. Approximately 400 ml was decanted off the top and was used as a stock solution. The stock solution was placed in an ultrasonic bath for 10 minutes, and 750 μl of the stock solution was added to filtered deionized water to make 755 ml of particle suspension. The suspension was shaken on a W.S. Tyler RX-86 biaxial shaker for 5 minutes, and particle concentration was measured using 190 ml of the suspension. A dry wipe was weighed and then added to the remaining 565 ml of particle suspension in the jar. The suspension and wipe were shaken on a biaxial shaker for 5 minutes. The wipe was removed from the jar and the particle concentration was measured. The wipe was next added to a jar containing 565 ml of filtered deionized water, then shaken on a biaxial shaker for 5 minutes, then the wipe was removed. The weight and dimensions of the wet wipe were measured and recorded, and the particle concentration in the jar was measured.

Particle Capture is defined as the net reduction in particles in solution after agitation with the wipe. If the number of particles captured was negative, meaning that more particles were released into the water than removed, Particle Capture was defined as zero.

Particle Capture(Count)=Initial Particles in Suspension−Particles Remaining After Exposure to Wipe Particle Capture(Percent)=(Particle Capture(Count)/Initial Particles in Suspension)×100%

Particle Retention is defined as the number of the captured particles that are retained by the soiled wipe after agitation in clean water. If the number of particles retained was negative, particle retention was defined as zero.

Particle Retention(Count)=Particle Capture(Count)−Particles Released

Particle Retention(Percent)=(Particle Retention (Count)/Particle Capture (Count))×100%

Figure 9:
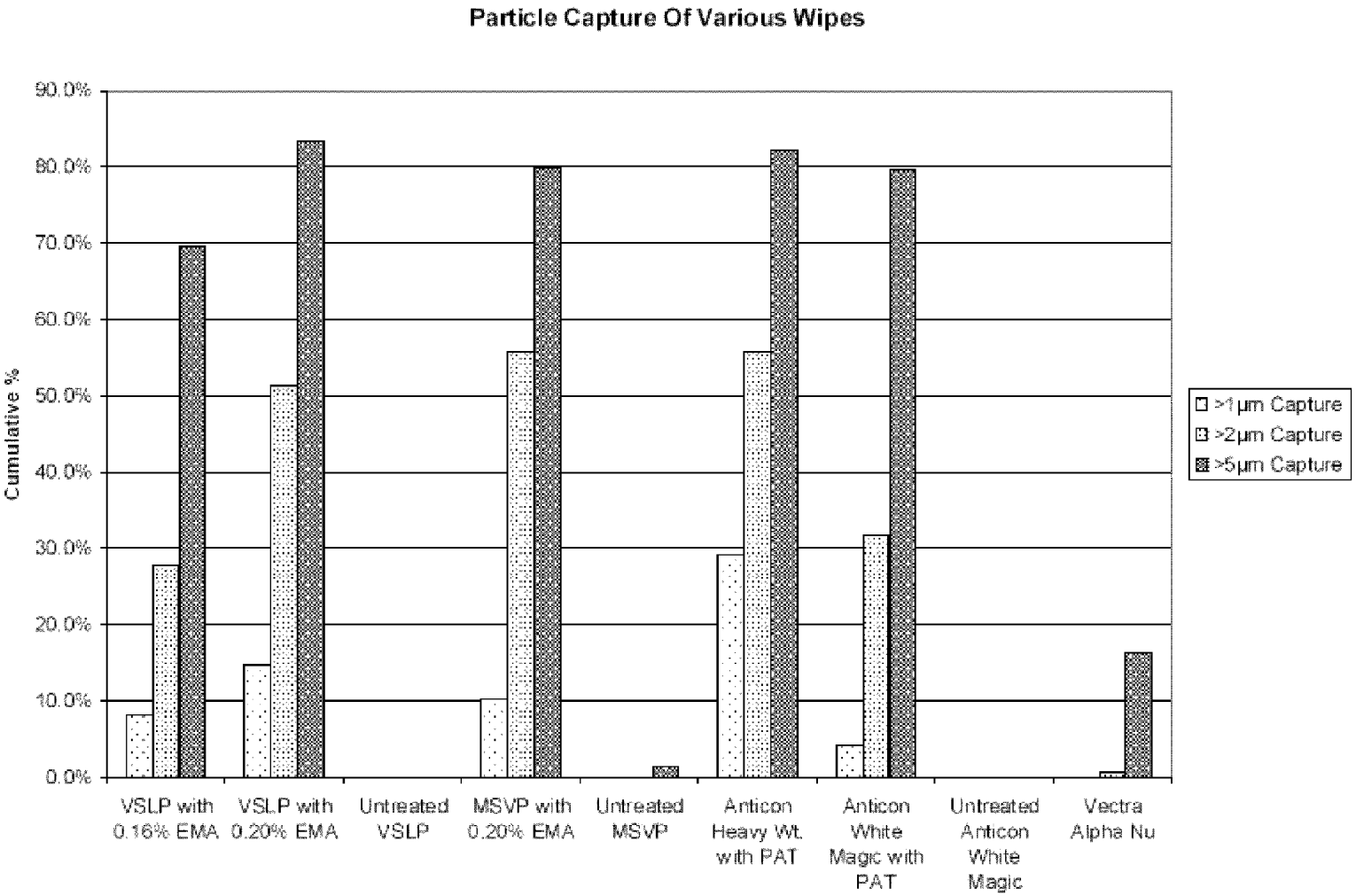
FIG. 9 graphically compares particle capture of some embodiments of the present inventions with some commercially available products, using a bar graph.
Figure 10:
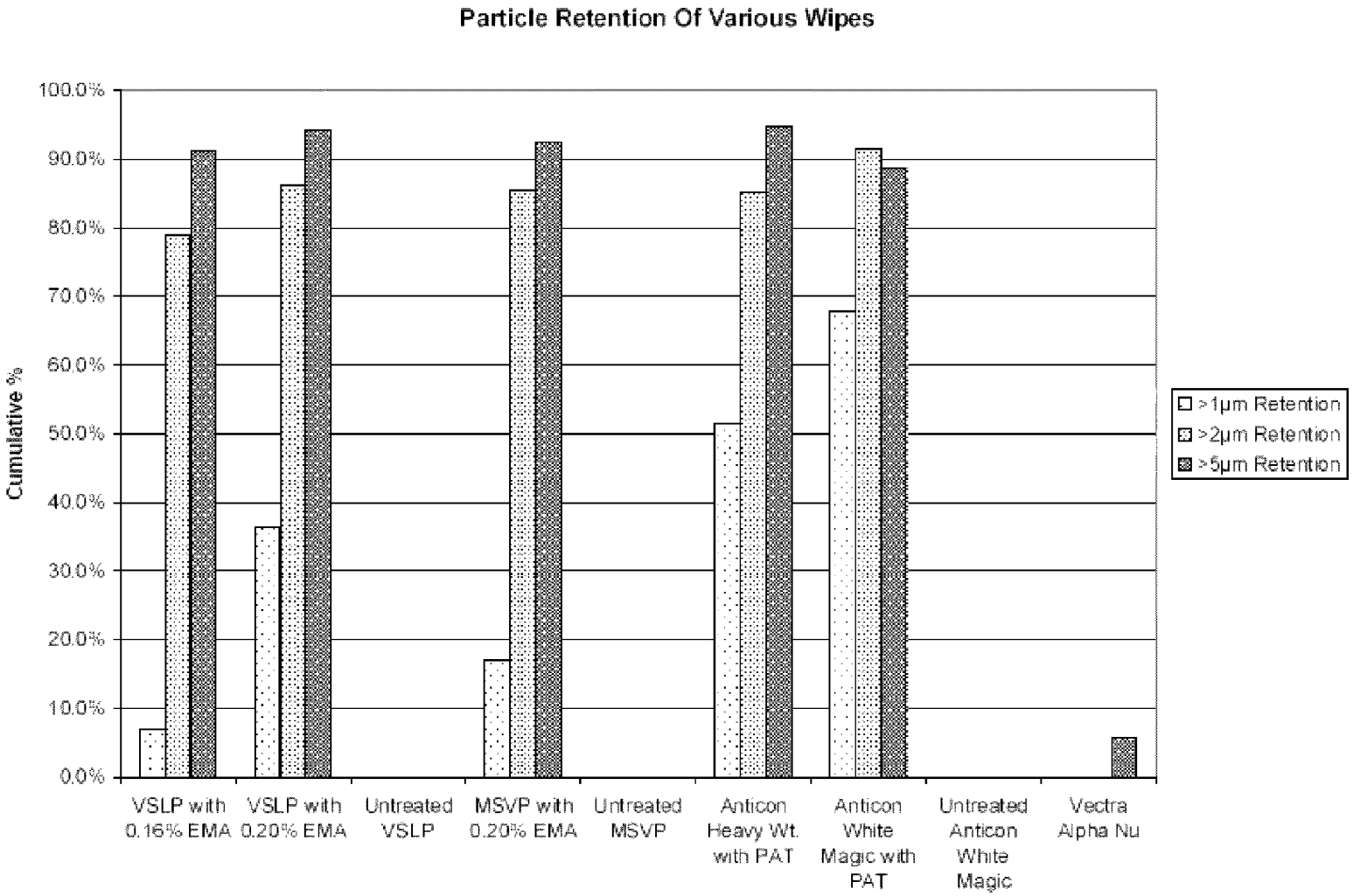
FIG. 10 graphically compares particle retention of some embodiments of the present inventions with some commercially available products, using a bar graph.

Particle Capture and Retention Data are set forth in Table 3, and FIGS. 9 and 10:

TABLE 3

Comparison of Particle Capture and Retention

| Sample | Product Name | Chemical Treatment (% on wt. of fabric) | Particle Capture (Cumulative %) | | | Particle Retention (Cumulative %) | | |
|---|---|---|---|---|---|---|---|---|
| | | | ≧1 μm | ≧2 μm | ≧5 μm | ≧1 μm | ≧2 μm | ≧5 μm |
| 1 | ValuSeal LP | 0.16% EMA | 8.1% | 27.7% | 69.6% | 7.0% | 78.8% | 91.3% |
| 2 | ValuSeal LP | 0.20% EMA | 14.8% | 51.3% | 83.3% | 36.5% | 86.3% | 94.3% |
| 3 | ValuSeal LP | NONE | 0.0% | 0.0% | 0.0% | N/C | N/C | N/C |
| 4 | MicroSeal VP | 0.20% EMA | 10.4% | 55.8% | 80.0% | 16.9% | 85.6% | 92.5% |
| 5 | MicroSeal VP | NONE | 0.0% | 0.0% | 1.3% | N/C | N/C | 0.0% |
| 6 | Anticon Heavy Wt. | UNKNOWN | 29.1% | 55.7% | 82.3% | 51.5% | 85.1% | 94.7% |
| 8 | Anticon White Magic | UNKNOWN | 4.3% | 31.7% | 79.5% | 67.9% | 91.5% | 88.7% |
| 9 | Anticon White Magic | NONE | 0.0% | 0.0% | 0.0% | N/C | N/C | N/C |
| 12 | Vectra Alpha Nu | UNKNOWN | 0.0% | 0.7% | 16.4% | N/C | 0.0% | 5.8% |

As can be seen from Table 3 and FIGS. 9 and 10, EMA imparts an ability to capture and retain particles that is approximately equivalent to other finishes. Moreover, particle generation tested by both Biaxial Shake—IEST RP CC004.3 Section 6.1.3 and Helmke Drum—IEST RP CC003-87-T Section 5.3, modified to measure particulate generation on a sample size of 10 wipers, does not appear to be significantly affected by EMA. This is shown in Table 4 below:

TABLE 4

Comparison of Particle Generation

| Sample | Product Name | Chemical Treatment (% on wt. of fabric) | Biaxial Shake Particle Generation (>0.5 μm × $10^3$/cm$^2$) | Helmke Drum Particle Generation (>0.5 μm/ft$^3$/wiper) |
|---|---|---|---|---|
| 1 | ValuSeal LP | 0.16% EMA | 0.85 | NT |

TABLE 4-continued

Comparison of Particle Generation

| Sample | Product Name | Chemical Treatment (% on wt. of fabric) | Biaxial Shake Particle Generation (>0.5 μm × $10^3/cm^2$) | Helmke Drum Particle Generation (>0.5 μm/$ft^3$/wiper) |
|---|---|---|---|---|
| 2 | ValuSeal LP | 0.20% EMA | 0.58 | 4 |
| 3 | ValuSeal LP | NONE | 0.31 | N/T |
| 4 | MicroSeal VP | 0.20% EMA | 0.8 | 2.5 |
| 5 | MicroSeal VP | NONE | 0.51 | 3 |
| 6 | Anticon Heavy Wt. | UNKNOWN | 0.23 | 13 |
| 8 | Anticon White Magic | UNKNOWN | 0.42 | 4 |
| 9 | Anticon White Magic | NONE | 0.66 | N/T |
| 10 | Anticon Light Wt. w/PAT | UNKNOWN | 0.53 | 17 |
| 11 | Anticon Standard Wt. | UNKNOWN | 0.35 | 16 |
| 12 | Vectra Alpha Nu | UNKNOWN | 0.78 | N/T |

Finally, a compilation of the experimental and test results are shown in FIG. 11 to further show the various unexpected improvements due to the present inventions.

Certain modifications and improvements will occur to those skilled in the art upon a reading of the foregoing description. By way of example, the copolymer could be changed with possible substitutes being polypropylene, vinyl and acrylic while still maintaining the actual functional group. Similarly, the anhydride type could be changed with possible substitutes being acetic anhydride, malic acid and maleic acid. Also, the use of microdenier yarns for all or part of the knit structure or the use of monofilament yarns for a portion of the knit structure may yield further improvements such as increased surface area and improved removal of particles from surfaces (scrubbing ability). The use of yarns with filaments of various cross sections (round, trilobal, pie, dog bone, ribbon, star, etc.) and the use of conductive yarns for all or part of the knit structure (for ESD purposes) may also be desirable for special applications. This could include mixtures of natural and synthetic fibers or yarns in the substrate. In addition, other chemical treatment in conjunction with EMA such as antistats, antimicrobials, soil release agents, etc. could be applied to the wipes of the present inventions. Also, the use of surfactant types during laundering other than nonionic such as anionic, amphoteric or cationic as well as also laundering without the addition of surfactant may be desirable for some applications. Finally, it is expected that the present inventions would also provide affinity for particulate matter in addition to carbon black. Applicable particles may include aluminum oxide, manganese oxide, titanium dioxide, zinc oxide, aluminum, copper, copper oxide, graphite, graphite, iron, ferric oxide, zinc, silicon, silicon dioxide, etc. It should be understood that all such modifications and improvements have been deleted herein for the sake of conciseness and readability but are properly within the scope of the following claims.

We claim:

1. A supply of clean room wipes, said product comprising:
(a) a sealed package; and
(b) a plurality of wipes within said sealed package, said plurality of wipes having a ethylene maleic anhydride (EMA) particle capture and retention finish of between about 0.02 wt. % and about 2 wt. % solids on weight of said substrate, having a Strength Contribution from Treatment (lbs) when tested using a standard trap tear method ASTM D 5587:1996 of greater than about 10% and an average improvement in Percent Carbon Black Pick-Up greater than about 10% compared to an untreated wipe.

2. The product according to claim 1 further including a sealed edge along the perimeter of each wipe to prevent loss of material from said wipe during use.

3. The product according to claim 2 further including a saturant.

4. The product according to claim 3, wherein said saturant is chosen from alcohols, water, ketones, hypochlorites, peroxides, biostats, biocides, lubricants, surfactants and mixtures thereof.

5. The product according to claim 2, wherein said plurality of wipes are sterilized.

6. The product according to claim 5, wherein said plurality of wipes are irradiated until substantially sterile.

7. The product according to claim 2, wherein said plurality of wipes are clean room laundered prior to packaging.

8. The product according to claim 1 further including an outer bag surrounding said sealed package, which is adapted to be removed prior to use.

9. The product according to claim 1, wherein said sealed package is resealable.

10. The product according to claim 1, wherein said sealed package is solvent resistant.

11. The product according to claim 1, wherein said sealed package forms a sterile barrier between the environment and said plurality of wipes.

12. The product according to claim 1, wherein said material forming said sealed package is selected from the group consisting of laminates, films, metalized films and combinations thereof.

13. A textile article having a particle capturing finish, said product comprising:
(a) a substrate; and
(b) an ethylene maleic anhydride (EMA) finish applied to said substrate at between about 0.02 wt. % and about 2 wt. % solids on weight of said substrate.

14. The product according to claim 13, wherein said substrate is formed of synthetic yarns.

15. The product according to claim 14, wherein said synthetic yarns are polyester.

16. The product according to claim 14, wherein said synthetic yarns are between about 30 denier and about 200 denier.

17. The product according to claim 16, wherein said synthetic yarns are about 70 denier.

18. The product according to claim 14, wherein said synthetic yarns are texturized.

19. The product according to claim 18, wherein said synthetic yarns are air texturized.

20. The product according to claim 19, wherein said synthetic yarns are air texturized without entanglement.

21. The product according to claim 13, wherein said substrate is between about 40 gms/$meter^2$ and about 300 gms/$meter^2$.

22. The product according to claim 13, wherein said substrate is formed by circular knitting.

23. The product according to claim 22, wherein said substrate formed by circular knitting is slit prior to packaging.

24. The product according to claim 13, wherein said ethylene maleic anhydride (EMA) finish is topically applied.

25. The product according to claim 24, wherein said topically applied finish is applied by immersion and padding.

26. The product according to claim 13, wherein said ethylene maleic anhydride (EMA) finish is between about 0.1 wt. % and 0.5 wt. % solids on weight of substrate.

27. A supply of clean room wipes, said supply of clean room wipes comprising:

(a) a sealed package;

(b) a plurality of wipes within said sealed package, said wipes including (i) a substrate and (ii) an ethylene maleic anhydride (EMA) finish applied to said substrate at between about 0.02 wt. % and about 2 wt. % solids on weight of substrate, wherein said plurality of wipes having a Strength Contribution from Treatment (lbs) when tested using a standard trap tear method ASTM D 5587: 1996 of greater than about 10% and an average improvement in Percent Carbon Black Pick-Up greater than about 10% compared to an untreated wipe; and (c) a sealed edge along the perimeter of each wipe to prevent loss of material from said wipe during use.

28. The product according to claim 27 further including a saturant.

29. The product according to claim 28, wherein said saturant is chosen from alcohols, water, ketones, hypochlorites, peroxides, biostats, biocides, lubricants, surfactants and mixtures thereof.

30. The product according to claim 27, wherein said plurality of wipes are sterilized.

31. The product according to claim 30, wherein said plurality of wipes are irradiated until substantially sterile.

32. The product according to claim 27, wherein said plurality of wipes are clean room laundered prior to packaging.

33. The product according to claim 27 further including an outer bag surrounding said sealed package, which is adapted to be removed prior to use.

34. The product according to claim 27, wherein said sealed package is resealable.

35. The product according to claim 27, wherein said sealed package is solvent resistant.

36. The product according to claim 27, wherein said sealed package forms a sterile barrier between the environment and said plurality of wipes.

37. The product according to claim 27, wherein said material forming said sealed package is selected from the group consisting of laminates, films, metalized films and combinations thereof.

38. The product according to claim 27, wherein said substrate is formed of synthetic yarns.

39. The product according to claim 38, wherein said synthetic yarns are polyester.

40. The product according to claim 38, wherein said synthetic yarns are between about 30 denier and about 200 denier.

41. The product according to claim 40, wherein said synthetic yarns are about 70 denier.

42. The product according to claim 38, wherein said synthetic yarns are texturized.

43. The product according to claim 42, wherein said synthetic yarns are air texturized.

44. The product according to claim 43, wherein said synthetic yarns are air texturized without entanglement.

45. The product according to claim 27, wherein said substrate is between about 40 gms/meter$^2$ and about 300 gms/meter$^2$.

46. The product according to claim 27, wherein said substrate is formed by circular knitting.

47. The product according to claim 46, wherein said substrate formed by circular knitting is slit prior to packaging.

48. The product according to claim 27, wherein said ethylene maleic anhydride (EMA) finish is topically applied.

49. The product according to claim 48, wherein said topically applied finish is applied by immersion and padding.

50. The product according to claim 27, wherein said ethylene maleic anhydride (EMA) finish is between about 0.1 wt. % and 0.5 wt. % solids on weight of substrate.

51. The product according to claim 27, wherein said ethylene maleic anhydride (EMA) finish is a co-polymer.

* * * * *

UNITED STATES PATENT AND TRADEMARK OFFICE

CERTIFICATE OF CORRECTION

PATENT NO. : 8,431,497 B2
APPLICATION NO. : 12/546912
DATED : April 30, 2013
INVENTOR(S) : Davidson et al.

It is certified that error appears in the above-identified patent and that said Letters Patent is hereby corrected as shown below:

Title Page, item [73] Assignee: Highland Industries, Inc., should be listed as an assignee on the face of the patent.

Title page, Column 2, US Application Serial No. 2004/0065972 to Zhu et al should be listed under Cited References.

In the Specification

In Column 2, Line 7, after the word room, the words "wipes and" should be added.

In Column 2, Line 15, the word forms should be "form".

In Column 3, Line 46, the "," should be deleted between the third occurrence of the words hot and air.

In Column 7, Line 52, the correct symbol is $\geq$.

In Column 9, Line 52, the second occurrence of "graphite" should be deleted.

Signed and Sealed this
Twenty-fifth Day of June, 2013

Teresa Stanek Rea
*Acting Director of the United States Patent and Trademark Office*